United States Patent [19]

Ackermann et al.

[11] Patent Number: 4,679,701

[45] Date of Patent: Jul. 14, 1987

[54] RESEALABLE PACK

[75] Inventors: Horst W. Ackermann, Orbe; Petr Masek, Yverdon; Jean Servaux, Savigny, all of Switzerland

[73] Assignee: Nestec S. A., Vevey, Switzerland

[21] Appl. No.: 745,590

[22] Filed: Jun. 17, 1985

[30] Foreign Application Priority Data

Jul. 5, 1984 [CH] Switzerland ..... 3248/84

[51] Int. Cl.[4] ..... B65D 43/24; B65D 90/04

[52] U.S. Cl. ..... 220/404; 220/335; 220/403; 220/463; 229/125; 383/33; 383/119

[58] Field of Search ..... 220/416, 418, 462, 463, 220/335, 461, 403, 404; 229/37 E, 43, 125, 17 R; 383/33, 119; 206/45.29, 45.3, 621

[56] References Cited

U.S. PATENT DOCUMENTS

| | | | |
|---|---|---|---|
| 1,470,686 | 10/1923 | Carpenter | 220/335 |
| 1,985,587 | 12/1934 | Storrs, Jr. | 220/335 |
| 2,233,704 | 3/1941 | Hohl et al. | 220/404 |
| 2,282,207 | 5/1942 | Palmer | 383/119 |
| 2,292,653 | 8/1942 | Palmer | 220/463 |
| 2,345,486 | 3/1944 | Leebov | 206/621 |
| 2,463,313 | 3/1949 | Ringler | 220/418 |
| 2,630,914 | 3/1953 | Bekoff | 206/45.29 |
| 2,951,628 | 9/1960 | Grussen | 220/461 |
| 2,959,336 | 11/1960 | Mosse et al. | 220/418 |
| 3,326,364 | 6/1967 | Waldrop et al. | 220/416 |
| 3,392,901 | 7/1968 | Krzyzanowski | 220/462 |
| 3,411,264 | 11/1968 | Farquhar | 220/404 |
| 3,482,758 | 12/1969 | Pierre et al. | 220/418 |
| 3,521,807 | 7/1970 | Weisberg | 220/462 |
| 4,324,357 | 4/1982 | Murkowski | 220/416 |
| 4,484,683 | 11/1984 | Werner, Jr. | 229/17 R |

FOREIGN PATENT DOCUMENTS

| | | | |
|---|---|---|---|
| 1194277 | 5/1959 | France | 220/404 |

*Primary Examiner*—William Price
*Assistant Examiner*—Gary E. Elkins
*Attorney, Agent, or Firm*—Vogt & O'Donnell

[57] ABSTRACT

The invention relates to a resealable pack consisting of an outer, relatively rigid envelope and a flexible, gusseted inner bag attached to the envelope, in which the outer envelope comprises at least one flap which, when turned down to seal the pack, folds and squeezes the two faces of the open end of the bag. The two lateral walls of the outer envelope have no moveable parts.

6 Claims, 5 Drawing Figures

FIG. 2
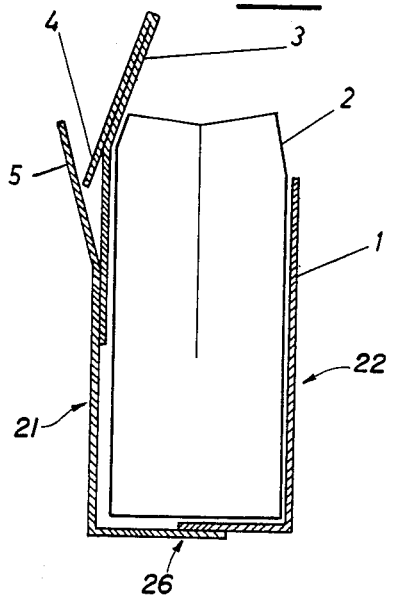
FIG. 3
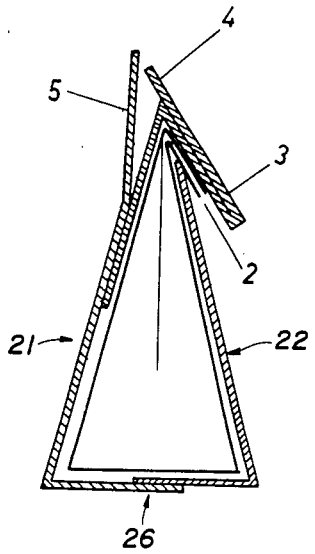
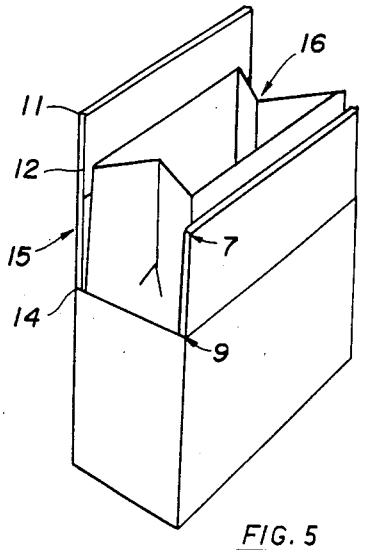
FIG. 5
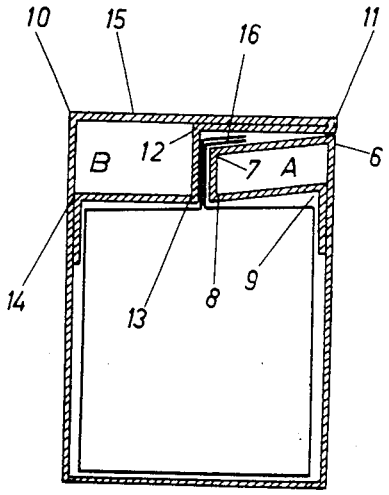
FIG. 4

RESEALABLE PACK

This invention relates to a resealable pack consisting of an outer, relatively rigid envelope and a flexible, gusseted inner bag.

There are already various known packs of which the function is to improve the tightness of the pack after packing of the product and sealing of the inner bag. U.S. Pat. No. 2,463,313 relates in particular to one such process in which a tight seal is established by folding and applying heat and pressure to the inner bag in a certain manner. However, no published patent mentions the problem which arises after the pack has been opened for the first time when it is desired to keep the product thus available in its original pack. Accordingly, the problem addressed by the present invention is to find a resealable pack which guarantees tightness and impermeability, i.e., a good shelf life of the product after the pack has been opened, but which on the other hand is fairly simple to handle for consumers and sufficiently attractive in price compared with current packs. The resealable pack according to the invention meets these requirements.

The present invention relates to a resealable pack consisting of an outer, relatively rigid envelope and a flexible, gusseted inner bag attached to the envelope, in which the outer envelope comprises at least one flap which, when turned down to seal the pack, folds and squeezes the two faces of the open end of the bag, and the two lateral walls of the envelope have no moveable parts.

In the context of the invention, moveable parts are understood to be, for example, triangular tabs which facilitate the folding of the gusset of the inner bag.

The resealable pack according to the invention may be used above all for the packing of foods, although it could also be used for other industrial applications. In the food field, the pack may be used for packing products sensitive to air and/or moisture and/or products required to keep their aroma, such as instant or roasted coffee, for example.

In a first embodiment of the pack according to the invention, the outer envelope comprises a flap which is an extension of its rear wall and which folds and squeezes the two faces of the open end of the bag around the upper edge of the front wall of the envelope through an angle of from 90° to 180°.

In this case, means are provided for fastening together the rear wall and front wall of the outer envelope, for example a fastening system of the Velcro type or any other known fastening system. The angle through which the end of the bag is folded is preferably between 110° and 150°.

In a second embodiment of the pack according to the invention, the envelope comprises a flap provided with an extension and a flexible element co-operating with that extension to keep the flap open or closed, the flap folding and squeezing the two faces of the open end of the bag through an angle of from 90° to 180°. The folding angle of the pack is preferably comprised between 140° and 180°.

In a third embodiment of the pack according to the invention, the envelope comprises a sheet folded over to form a flap and, in the closed position, a parallelepipedic enclosure co-operating with a second flap which also forms a parallelepipedic enclosure in the closed position, these parallelepipedic enclosures co-operating with one another to squeeze the two faces of the end of the bag. In this case, the end of the bag is partly bonded to the parallelepipedic enclosures so that the raising of the flap causes the bag to open.

The inner bag is a gusseted bag made from a thin film from 0.02 to 0.3 mm thick. The nature of this film depends on the product to be packed: optionally coated paper, a plastic, such as polyester, optionally metallized, an aluminium laminate etc., depending on whether the bag is intended to be impervious to moisture and/or oxygen, for example.

For manufacture, it is generally of advantage for the film to be heat-sealable.

For example, a sheet is longitudinally folded over and sealed edge-to-edge and then sealed transversely at one end after formation of the lateral gussets, after which the bag is filled and sealed transversely at its other end. For the pack according to the invention, it is preferable for the lower end to be flattened for adaptation to the bottom of the outer envelope.

Another method of forming a gusseted bag comprises longitudinally folding the two sides of a sheet over the depth of the gussets, then folding the sheet transversely so that the two side edges meet on the inside and subsequently welding them together. The bag is thus open at one end through which it is filled, after which this end is sealed and preferably flattened to form the base.

In a variant, the upper part of the bag is provided with a tearing element, such as a wire or strip. Otherwise, the sealed bag may be opened by cutting the upper part.

The outer envelope is essentially formed of at least one relatively rigid, 0.4 to 1.5 mm thick sheet of, for example, carton laminated or coated carton or plastic. In one preferred embodiment, it has a square or rectangular base and the closure flap is situated at the top.

The pack according to the invention is illustrated in the accompanying drawings, wherein:

FIG. 2 is a vertical section through the second embodiment of the pack according to the invention in the open position.

FIG. 3 shows the pack of FIG. 2 in the closed position.

FIG. 4 is a vertical section through the third embodiment of the pack according to the invention in the closed position.

FIG. 5 shows the pack of FIG. 4 in the open position.

Figure 1:
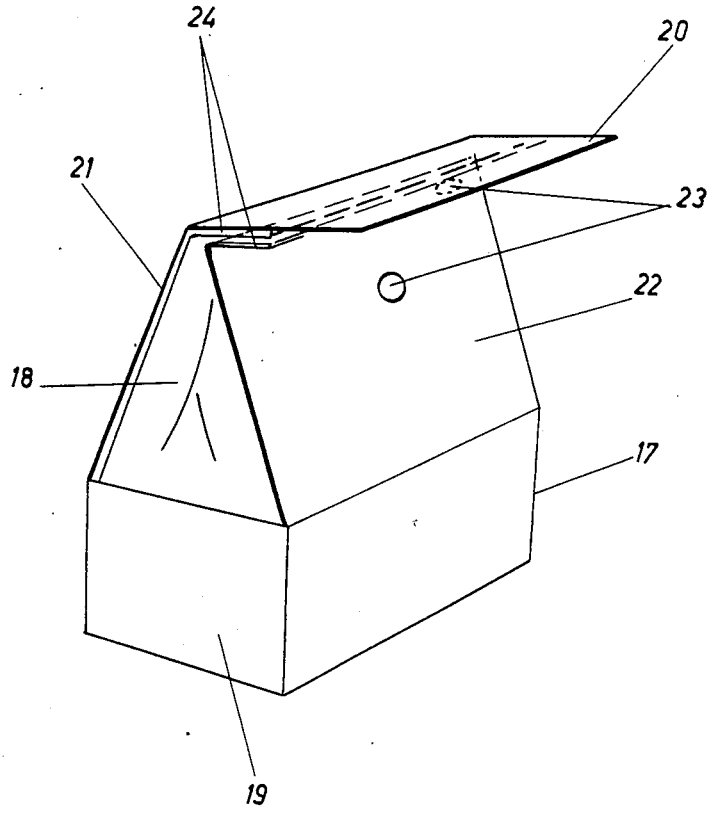
FIG. 1 is perspective view of the first embodiment of the pack.

As shown in FIG. 1, the outer envelope 17 surrounds a gusseted bag 18 accommodating the packed product. The side walls of the envelope 19 have no folding tabs. The base bottom of the envelope comprises a rectangular box. The flap 20 is reciprocably movable and is an extension of the rear wall 21 of the outer envelope and folds and squeezes the two faces 24 of the end of the bag 18 around the upper opposing front wall 22. After folding, the end of the bag preferably extends for 5 to 30 mm. A fastening system of the Velcro type 23 enables the flap 20 to be fixed to the front wall 22 so that the pack is kept firmly closed, above all when it has already been opened.

In a second embodiment (FIGS. 2, 3), the outer envelope 1 has two opposing front and rear walls 21 and 22 interconnected by a base bottom 26 surrounds a bag 2, leaving its sides free. In the embodiment shown in the drawing, the envelope is made of two sheets bonded to one another at the base bottom after filling through the bottom. Alternatively, if the bag is filled from the top, the envelope 1 is made of a single sheet.

One of the faces of the envelope 1 comprises a flap 3 provided with an extension 4 and a flexible element 5 co-operating with the extension to keep the flap 3 open or closed. The upper end of the bag 2 is bonded to the envelope 1 at the flap 3.

In the position shown in FIG. 2, the pack is open and the flexible element 5 keeps it in that position. To close the pack, the faces of the envelope 1 are brought together at their upper ends and the flap 3 is turned down beyond the dead point of the flexible element 5, as shown in FIG. 3 so that the flap 3 is kept closed. The two faces of the end of the bag 2 are thus folded and squeezed by the flap 3, so that the pack is tightly sealed.

In a third embodiment (FIGS. 4 and 5), the outer envelope surrounds a bag on at least four sides to form a box. In the closed position (FIG. 4), one part of the envelope is folded along the edges 6, 7, 8, 9 and then bonded to the outer wall to form a parallelepipedic enclosure A. Another part of the envelope is folded along the edges 10, 11, 12, 13, 14 and bonded to the outer wall to form a parallelepipedic enclosure B and a flap 15. The end 16 of the inner bag is bonded to the enclosure A along the edge 8 and to the enclosure B along the edge 13. In the closed position, the two faces of the end 16 are squeezed between those enclosures.

The pack is opened as follows:

The flap 15 is raised, pivoting about the edge 10. The enclosure B behaves like a deformable parallelogram of which the fixed pivots are the edges 10 and 14 and the moving pivots the edges 12 and 13. This means that the part situated between the edges 12 and 13 pivots upwards and to the left. By virtue of the bond along the edge 13, the left-hand part of the end of the bag 16 follows that movement and, because of its gusseted construction, the bag tends to open from both sides. The right-hand part of the end of the bag 16 is entrained upwards by the left-hand part and, by virtue of the bond along the edge 8, the part situated between the edges 7 and 8 is initially drawn upwards. As with the enclosure B, enclosure A represents a parallelogram deformable about fixed pivots 6 and 9 and the part situated between the edges 7 and 8 pivots upwards and to the right. By moving the flap 15 and the enclosure A apart, complete opening is obtained, as shown in FIG. 5 where the enclosures A and B are completely flattened.

We claim:

1. A resealable pack comprising:

a gusseted bag, having an open end at its top, within a relatively rigid outer envelope in the form of a box having a bottom and at least two sets of opposing sidewalls having bottom edges affixed to the box bottom;

a first movable part having a top edge, two side edges and a bottom edge, and an inner and an outer face surface, the bottom edge being affixed to a top edge of a first of said sidewalls of the box;

a second movable part having a top edge, two side edges and a bottom edge, and an inner and an outer face surface, the bottom edge being affixed to a top edge of a second of said sidewalls of the box which opposes the first sidewall;

a first and a second moveable member each having two outer faces and two edges, one edge of the first and second movable members being affixed to the first and second movable parts, respectively, the other edge of the first and second movable members being affixed to the first and second sidewalls, respectively, such that when each movable member is in a closed position, the outer faces, sidewall and movable part define a deformable parallelogram, one face of each movable member being bonded to an outer face of the open end of the gusseted bag at a distance below the top of the bag, the faces of each movable member being of a length such that said one face of each closes and seals the bag when in a closed position; and a movable flap having a top edge and a bottom edge, the bottom edge being affixed to and extending from the top edge of the first movable part, the flap being of a length such that when in a closed position and folded over it extends to the bottom edge of the second movable part.

2. A resealable pack comprising a relatively rigid outer envelope encompassing a flexible gusseted inner bag having an open end wherein the outer envelope comprises:

a first wall and a second opposing wall, each wall having an inner face and an outer face and a top edge and a bottom edge;

a base bottom interconnecting the bottom edge of each wall;

two open lateral sides between the walls, the walls being movable such that the top edges of each wall are capable of being in proximate communication one with the other in a closed position such that the top edge of the second wall is in communication with the inner face of the first wall with the bag therebetween;

an elongated reciprocably movable flap portion extending from the top edge of the first wall having an inner face to which an outer face of the open end of the bag is bonded such that when the walls are brought into proximate communication, the flap is turned down and the bag is folded over the outer face of the second wall such that the flap folds and squeezes the faces of the bag together over the outer face of the second wall, the flap further having an extension protruding downward and outward from the interface between the flap and the first wall at the top edge of the first wall; and a reciprocably movable element portion extending upwardly from the outer face of the first wall and below the extent of the extension of the flap such that the flap extension and flexible element cooperate to keep the flap in open and closed positions.

3. A resealable pack as claimed in claim 2 wherein the base bottom comprises a rectangular box, the first and second opposing walls being extensions of the tops of opposing walls of the box.

4. A resealable pack as claimed in claim 2 or 3 wherein the flap folds and squeezes the two faces of the end of the bag around the edge of the outer face of the first wall through an angle of from 90° to 180°.

5. A resealable pack as claimed in claim 2 or 3 wherein when the flap is closed, the folded end of the bag extends for 5 to 30 mm over the outer face from the top edge of the first wall.

6. A resealable pack as claimed in claim 2 or 3 further comprising means for releasably affixing the flap to the outer face of the first wall.

* * * * *

UNITED STATES PATENT AND TRADEMARK OFFICE

CERTIFICATE OF CORRECTION

PATENT NO. : 4,679,701

DATED : July 14, 1987

INVENTOR(S) : Horst W. Ackermann, et al.

It is certified that error appears in the above-identified patent and that said Letters Patent is hereby corrected as shown below:

Column 2, line 57, between "upper" and "opposing" insert --edge of the--.

Signed and Sealed this

Twentieth Day of October, 1987

*Attest:*

DONALD J. QUIGG

*Attesting Officer*

*Commissioner of Patents and Trademarks*